US007387503B2

(12) United States Patent
Toda et al.

(10) Patent No.: US 7,387,503 B2
(45) Date of Patent: Jun. 17, 2008

(54) SCROLL FLUID MACHINE HAVING A FIXED SCROLL WITH A HEAT-RELEASING PROJECTION

(75) Inventors: Minako Toda, Yokohama (JP); Masatomo Tanuma, Yokohama (JP); Yuki Takada, Yokohama (JP); Naohiro Minekawa, Yokohama (JP)

(73) Assignee: Anest Iwata Corporation (JP)

( * ) Notice: Subject to any disclaimer, the term of this patent is extended or adjusted under 35 U.S.C. 154(b) by 0 days.

(21) Appl. No.: 11/621,740

(22) Filed: Jan. 10, 2007

(65) Prior Publication Data

US 2007/0172372 A1 Jul. 26, 2007

(30) Foreign Application Priority Data

Jan. 24, 2006 (JP) ..... 2006-014704

(51) Int. Cl.
*F01C 1/02* (2006.01)
*F03C 2/00* (2006.01)

(52) U.S. Cl. ..... 418/55.1; 418/60; 418/101; 165/80.3; 165/84

(58) Field of Classification Search ..... 418/55.1, 418/55.2, 60, 101; 165/80.3, 84
See application file for complete search history.

(56) References Cited

U.S. PATENT DOCUMENTS 5,417,554 A * 5/1995 Kietzman et al. ..... 418/101
5,558,156 A * 9/1996 Tsutsui ..... 165/84
5,775,888 A * 7/1998 Sakamoto et al. ..... 418/101
6,324,061 B1 * 11/2001 Kinoshita et al. ..... 165/80.3
2004/0241030 A1 12/2004 Matsushima

FOREIGN PATENT DOCUMENTS

JP 58035389 A * 3/1983 ..... 165/86
JP 2002016385 A * 1/2002

* cited by examiner

*Primary Examiner*—Theresa Trieu
(74) *Attorney, Agent, or Firm*—Ostrolenk, Faber, Gerb & Soffen, LLP

(57) ABSTRACT

In a scroll fluid machine, a fixed scroll has a fixed wrap, and an orbiting scroll has an orbiting wrap which engages with the fixed wrap to form a compressing chamber between the orbiting and fixed wraps. The orbiting scroll is rotatably mounted around an eccentric axial portion of a driving shaft and revolved by the driving shaft. A gas introduced from the outer circumference of the fixed scroll is compressed in the compressing chamber as it flows towards the center. Parts near the center is heated by a compressed gas. On the other surface of the fixed scroll to the surface having the fixed wrap, a plurality of cooling fins are provided. Air is introduced between the cooling fins to cool the machine. Between the cooling fins, a heat-releasing projection is provided to improve cooling efficiency.

12 Claims, 3 Drawing Sheets

SCROLL FLUID MACHINE HAVING A FIXED SCROLL WITH A HEAT-RELEASING PROJECTION

BACKGROUND OF THE INVENTION

The present invention relates to a scroll fluid machine and especially to a scroll fluid machine such as a scroll compressor or a scroll vacuum pump in which a fixed wrap of a fixed scroll engages with an orbiting wrap of an orbiting scroll mounted around an eccentric axial portion of a driving shaft, the orbiting scroll being eccentrically revolved by the driving shaft so that a gas sucked from the outer circumference of the fixed scroll can be compressed towards the center and discharged.

In a scroll fluid machine, a long-time operation increases temperature of an eccentric axial portion of a driving shaft, and bearings and packing that support the driving shaft to cause the bearings and packing to be damaged.

To prevent such situation, US2004/0241030A1 discloses a scroll fluid machine having a number of cooling fins on the surface of a fixed scroll to increase cooling efficiency.

However, in the scroll fluid machine, the cooling fins are radially provided on the surface of a fixed scroll to limit a cooling area and cooling performance. To increase the cooling area, increased number of the radial cooling fins makes gaps between the cooling fins denser to make cooling wind more unlikely to pass through to decrease cooling efficiency. Particularly, in the radial cooling fins, the gap between the cooling fins becomes narrower towards the center to make it more difficult for cooling wind to pass through towards the center having relatively higher temperature than in the outer circumference.

SUMMARY OF THE INVENTION

In view of the disadvantage in the prior art, it is an object of the invention to provide a scroll fluid machine improving cooling efficiency by increasing a cooling area along which air flows on the surface of a fixed scroll.

BRIEF DESCRIPTION OF THE DRAWINGS

The features and advantages of the invention will become more apparent from the following description with respect to embodiments as shown in accompanying drawings wherein.

DETAILED DESCRIPTION OF PREFERRED EMBODIMENTS

Figure 1:
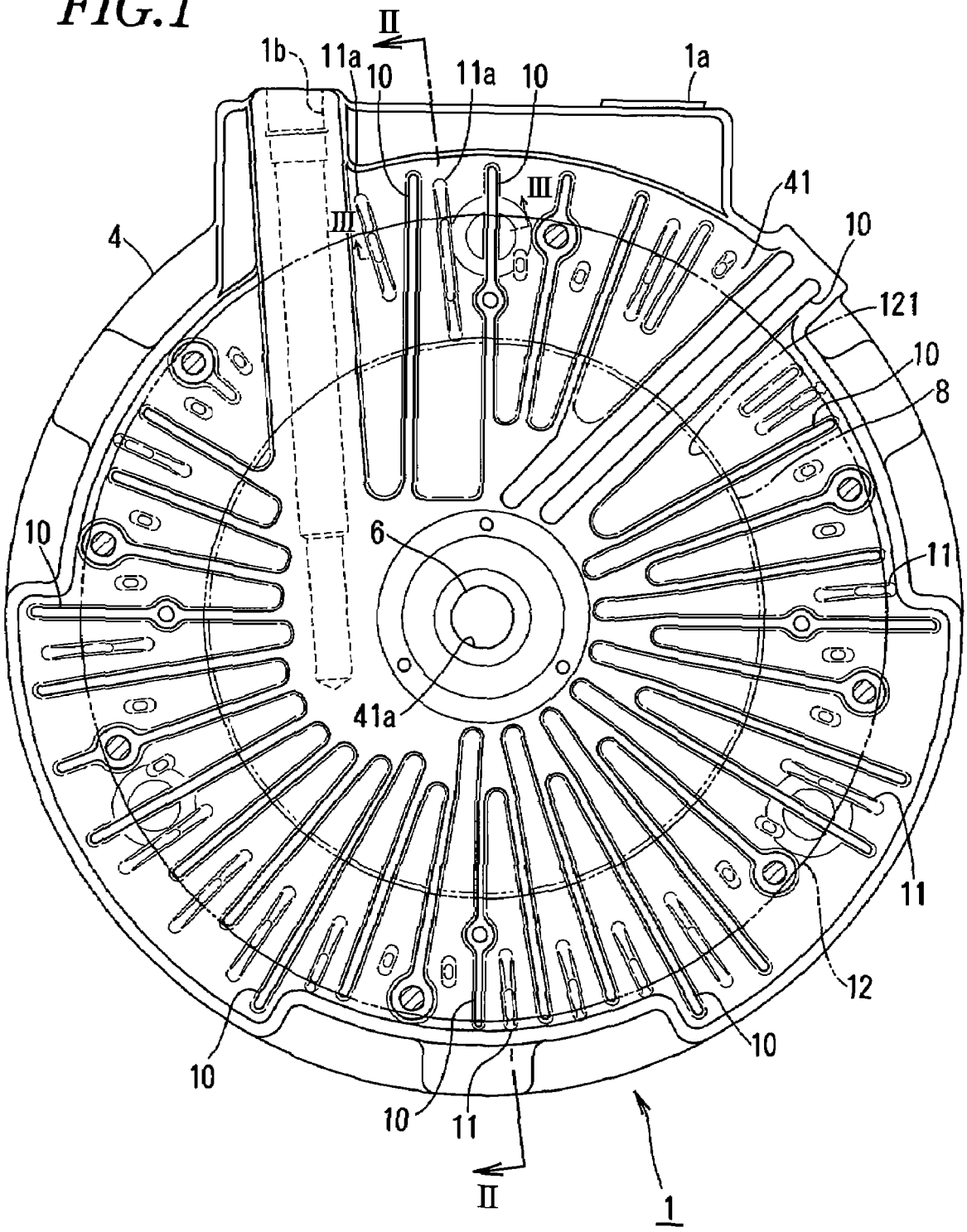
FIG. 1 is a front elevational view of a scroll fluid machine according to the present invention.

In FIG. 1, a cylindrical housing 1 comprises a rear casing 3 and a front cover 4. The housing 1 has an inlet 1*a* for sucking external air in the housing 1 and an outlet 1*b* for discharging a compressed gas compressed in the housing 1 to the outside.

The casing 3 and the cover 4 comprises approximately circular fixed end plates 31,41 facing each other and having fixed wraps 32 and 42 spirally formed as an involute curve to constitute fixed scrolls 33,43.

On the rear surface of the fixed scroll 33 and on the front surface of the fixed scroll 43, there are provided a plurality of cooling fins 10 radially extending from the center of the fixed scrolls 33,43 to the outer circumference and a plurality of short heat-releasing projections 11,11 each of which is disposed between the adjacent cooling fins 10 and 10.

The heat-releasing projection 11 is provided close to the outer circumference of each of the fixed scrolls 33,43 or at a wider gap between the adjacent cooling fins 10 and 10. The projection 11 is lower in height than the fin 10.

A number of radial cooling fins 10 and small heat-releasing projections 11 are provided on the surfaces of the fixed scrolls 33,43 of the housing 1 thereby increasing cooling area without making denser between the cooling fins 10 and 10 through which external air passes. Furthermore, when cooling fans 8,9 described later rotates, turbulence occurs in air current thereby preventing bearings 14,15 and packing from being damaged by heat.

In the radially-extending cooling fins 10, the gap between the adjacent cooling fins 10 and 10 becomes wider from the center toward the outer circumference. Thus, during operation, a finger of an operator is likely to put in the gap between the cooling fins 10 and 10 to cause hindrance in the operation. In this embodiment, the heat-releasing projection 11 is provided to prevent the operator's finger from putting in the gap thereby improving security.

Figure 2:
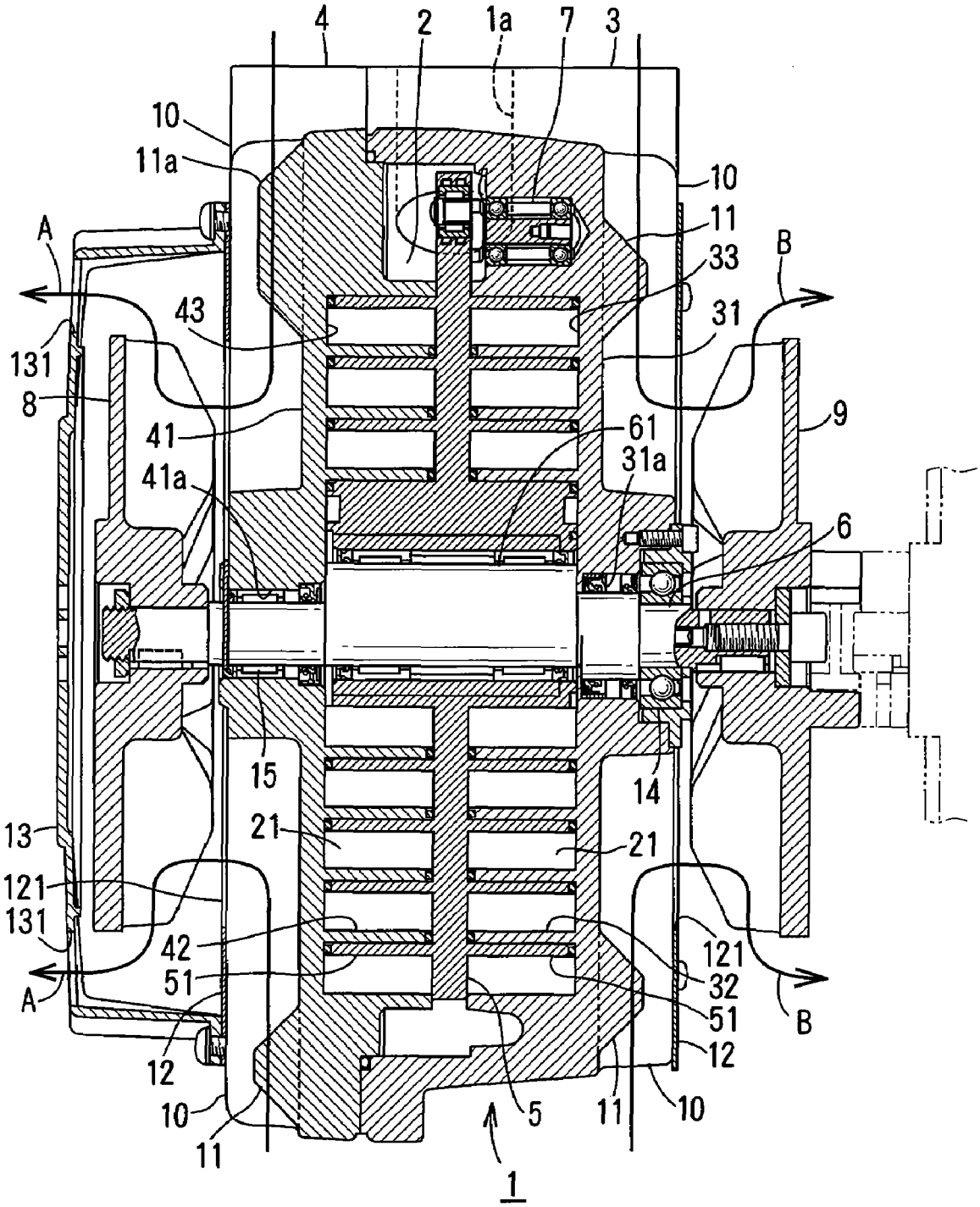
FIG. 2 is a vertical sectional view taken along the line II-II in FIG. 1.
Figure 3:
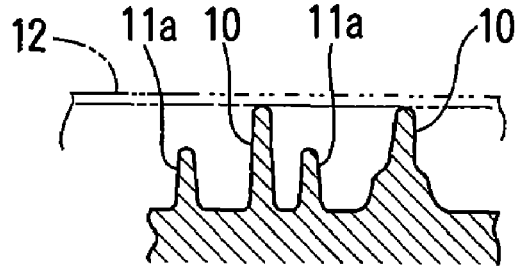
FIG. 3 is a horizontal sectional view taken along the line III-III in FIG. 1.
Figure 4:
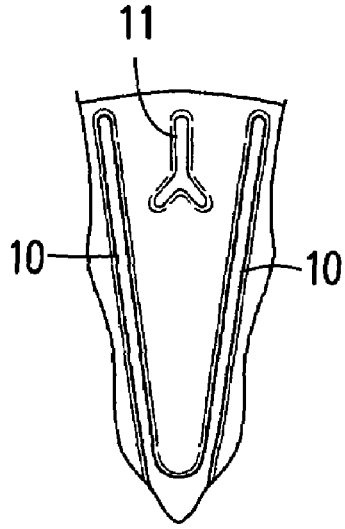
FIG. 4 is a front view of another embodiment of a heat-releasing projection.
Figure 5:
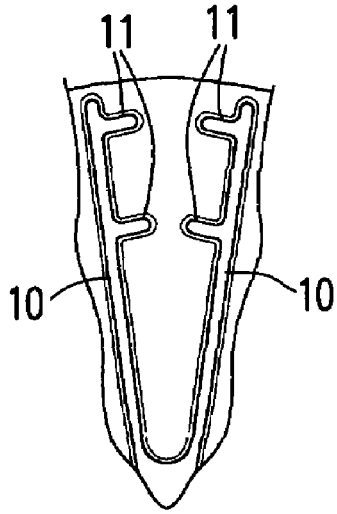
FIG. 5 is a front view of further embodiment of the heat-releasing projection.

The heat-releasing projection 11 extends radially straight or inclined as shown as 11*a* in FIGS. 1 and 2. The projection 11 may be forked at the radially inner end in FIG. 4, mounted to the side of the cooling fin 10 in FIG. 5, corrugated or bent, thereby increasing turbulence.

In a sealed chamber 2 between the fixed scrolls 33 and 43, an orbiting scroll 5 is rotatably supported around an eccentric axial portion 61 of a driving shaft 6 rotatably fitted in the center of the housing 1. The driving shaft 6 is connected at the rear end to a motor(not shown) and rotatably supported in axial holes 31*a*,41*a* along the center of the fixed end plates 31,41 via bearings 14,15.

The orbiting scroll 5 has on the front and rear surfaces orbiting wraps 51,51 engaging with the fixed wraps 32,42 respectively and is connected to the fixed end plate 31 with three known pin-crank-type self-rotation preventing devices 7.

The driving shaft 6 rotates by the motor, so that the orbiting scroll 5 is eccentrically revolved thereby gradually reducing the volume of the compressing chambers 21,21 towards the center. A external gas in the compressing chambers 21,21 from the inlet 1*a* is gradually compressed and finally discharged to the outside from the outlet 1*b*. External air sucked from the inlet 1*a* is compressed and its temperature rises as it flows towards the center.

To the driving shaft 6 which projects from the fixed end plates 41,31, the front and rear cooling fans 8,9 are mounted. The front cooling fan 8 rotates to produce external air current going forwards, while the rear cooling fan 9 rotates to produce air current going rearwards.

Cover plates 12,12 are fixed to the front surface of the cover 4 and the rear surface of the casing 3. In the cover 4, a cover protection 13 is mounted on the front surface of the cover plate 12 to cover the cooling fan 8.

The rear surfaces of the cover plates 12,12 contact the cooling fins 10,10 but does not contact the heat-releasing projections 11,11. Thus, the front and rear cooling fans 8,9 rotate to allow external air to pass towards the center between the cooling fins 10. The rear surfaces of the cover plates 12,12 may be placed close to the cooling fins 10,10 without contacting them.

In the front side of the housing 1, rotation of the front cooling fan 8 allows external air A to be sucked between the cooling fins 10 and 10 on the outer circumference of the cover 4.

Sucked air A goes towards the center along the side of the cooling fin 10 with turbulence by the heat-releasing projection 11 thereby increasing cooling effect. Air goes to the center without hindrance between the cooling fins 10 and 10 to effectively cool the center which is likely to become high temperature.

Air A sucked in the center is transferred forwards through an opening 121 and discharged from an opening 131 of the protecting cover 13.

In the rear part of the housing 1, the rear cooling fan 9 rotates to allow external air B to be sucked between the cooling fins 10 and 10 on the outer circumference of the casing 3. Sucked air B goes towards the center as well as air A and discharged through an opening 121 of the cover plate 12 rearwards to cool the motor disposed behind.

The embodiments relate to a both-side scroll fluid machine in which a both-side orbiting scroll is disposed between two fixed scrolls. The present invention may also apply to a one-side scroll fluid machine in which a one-side fixed scroll engages with a one-side orbiting scroll. With rotation of the cooling fans 8,9, external air current flows towards the center, but may flow towards the outer circumference.

The foregoing merely relate to embodiments of the invention. Various changes and modifications may be made by a person skilled in the art without departing from the scope of claims wherein:

What is claimed is:

1. A scroll fluid machine comprising:

a driving shaft having an eccentric axial portion;

a fixed scroll having an inner surface, an outer surface, a fixed wrap extending from the inner surface, and the fixed scroll having an outer peripheral circumference;

an orbiting scroll having an orbiting wrap, the orbiting scroll being rotatably secured around the eccentric axial portion of the driving shaft, the orbiting wrap engaging with the fixed wrap to form a compressing chamber, and the fixed scroll being operable to introduce a gas from the outer peripheral circumference of the fixed scroll into the compressing chamber, the gas being compressed as it flows towards a center of the scroll fluid machine;

a plurality of cooling fins on the outer surface of the fixed scroll; and a heat-releasing projection radially disposed straight along a radius extending from a central axis of the fixed scroll between adjacent cooling fins.

2. A scroll fluid machine of claim 1 wherein the heat-releasing projection is provided close to the outer peripheral circumference of the fixed scroll.

3. A scroll fluid machine of claim 1, further comprising a cover plate disposed over the cooling fins of the fixed scroll, the cover plate contacting the cooling fins but not contacting the heat-releasing projection.

4. A scroll fluid machine of claim 1 wherein a height of the heat-releasing projection is lower than a height of a cooling fin.

5. A scroll fluid machine comprising:

a driving shaft having an eccentric axial portion;

a fixed scroll having an inner surface, an outer surface, a fixed wrap extending from the inner surface, and the fixed scroll having an outer peripheral circumference;

an orbiting scroll having an orbiting wrap, the orbiting scroll being rotatably secured around the eccentric axial portion of the driving shaft, the orbiting wrap engaging with the fixed wrap to form a compressing chamber, and the fixed scroll being operable to introduce a gas from the outer peripheral circumference of the fixed scroll into the compressing chamber, the gas being compressed as it flows towards a center of the scroll fluid machine;

a plurality of cooling fins located on the outer surface of the fixed scroll; and a heat-releasing projection positioned between adjacent cooling fins, the heat-releasing projection being inclined with respect to a radius of the fixed scroll.

6. A scroll fluid machine of claim 5 wherein the heat-releasing projection is provided close to the outer peripheral circumference of the fixed scroll.

7. A scroll fluid machine of claim 5 wherein a height of the heat-releasing projection is lower than a height of a cooling fin.

8. A scroll fluid machine of claim 5, further comprising a cover plate disposed over the cooling fins of the fixed scroll, the cover plate contacting the cooling fins but not contacting the heat-releasing projection.

9. A scroll fluid machine comprising:

a driving shaft having an eccentric axial portion;

a fixed scroll having an inner surface, an outer surface, a fixed wrap extending from the inner surface, and the fixed scroll having an outer peripheral circumference;

an orbiting scroll having an orbiting wrap, the orbiting scroll being rotatably secured around the eccentric axial portion of the driving shaft, the orbiting wrap engaging with the fixed wrap to form a compressing chamber, and the fixed scroll being operable to introduce a gas from the outer peripheral circumference of the fixed scroll into the compressing chamber, the gas being compressed as it flows towards a center of the scroll fluid machine;

a plurality of cooling fins on the outer surface of the fixed scroll; and a heat-releasing projection positioned between adjacent cooling fins, the heat-releasing projection having a radially inner end and a forked portion formed at the radially inner end.

10. A scroll fluid machine of claim 9 wherein the heat-releasing projection is provided close to the outer peripheral circumference of the fixed scroll.

11. A scroll fluid machine of claim 9 wherein a height of the heat-releasing projection is lower than a height of a cooling fin.

12. A scroll fluid machine of claim 9, further comprising a cover plate disposed over the cooling fins of the fixed scroll, the cover plate contacting the cooling fins but not contacting the heat-releasing projection.

* * * * *